US005236405A

United States Patent [19]

Dohmann et al.

[11] Patent Number: 5,236,405

[45] Date of Patent: Aug. 17, 1993

[54] PLURAL POSITION JUMP ROPE APPARATUS

[76] Inventors: K. Paige Dohmann; A. Fred Dohmann, both of 2904 W. Bear Trails, Orange, Tex. 77630

[21] Appl. No.: 939,658

[22] Filed: Sep. 3, 1992

[51] Int. Cl.[5] ..... A63B 5/20

[52] U.S. Cl. ..... 482/82; 482/81

[58] Field of Search ..... 482/81, 82; 446/490

[56] References Cited

U.S. PATENT DOCUMENTS

| | | | |
|---|---|---|---|
| 169,625 | 11/1975 | Crandall | 482/81 |
| 3,064,971 | 11/1962 | Feinn | 482/82 |
| 3,072,402 | 1/1963 | McCombs | 482/82 |
| 3,107,092 | 10/1963 | Morris et al. | 482/82 |
| 3,138,377 | 6/1964 | Stewart | 482/82 |
| 3,419,270 | 12/1968 | Eppy | 482/82 |
| 4,022,462 | 5/1977 | Penna-Kipper | 482/81 |
| 4,184,677 | 1/1980 | Murray | 482/82 |

*Primary Examiner*—Richard J. Apley
*Assistant Examiner*—Jerome Donnelly
*Attorney, Agent, or Firm*—Leon Gilden

[57] ABSTRACT

A first and second jump rope assembly are interconnected by first and second jump rope second ends, with the first and second assemblies having first ends permitting ease of rotation of the jump rope assemblies in juxta position relative to one another for use by a plurality of individuals.

4 Claims, 4 Drawing Sheets

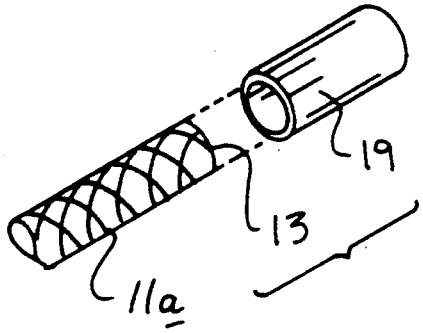
Fig 1
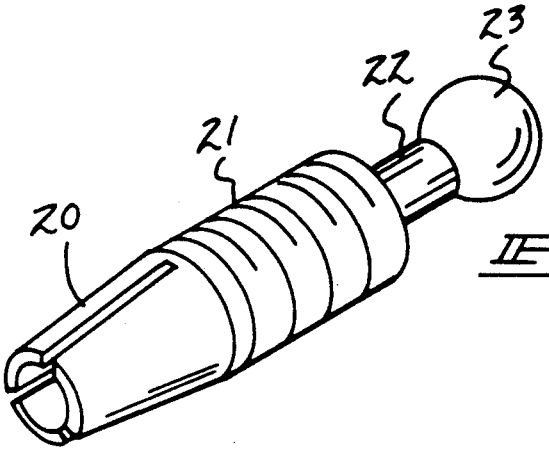
Fig 2
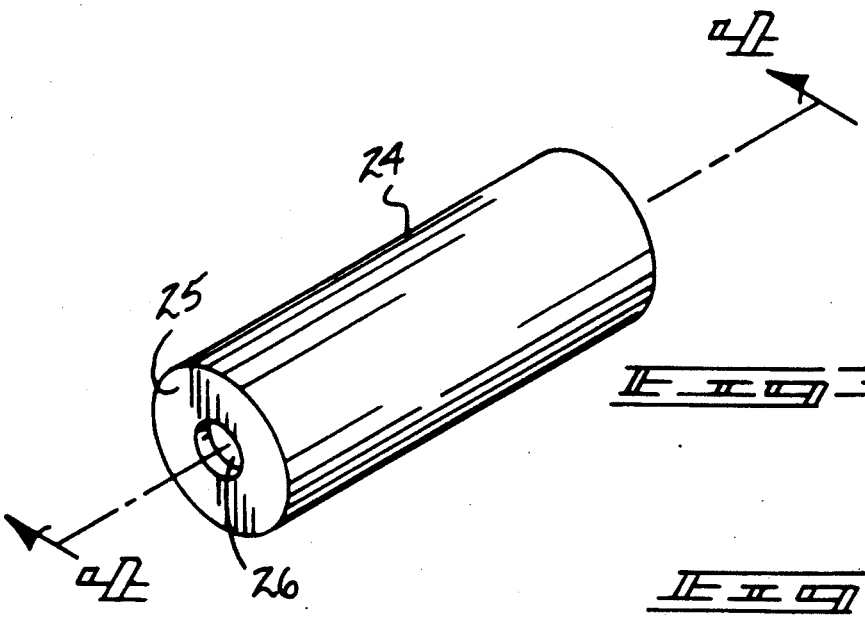
Fig 3
Fig 4
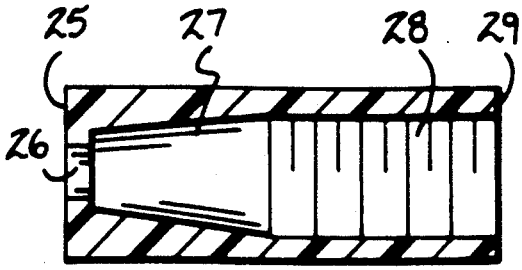

PLURAL POSITION JUMP ROPE APPARATUS

BACKGROUND OF THE INVENTION

1. Field of the Invention

The field of invention relates to jump rope apparatus, and more particularly pertains to a new and improved plural position jump rope apparatus wherein the same is arranged for utilization by a plurality of individuals simultaneously.

2. Description of the Prior Art

Jump rope apparatus of various types have been utilized throughout the prior art and typically comprises a single jump rope assembly of various structure for use by individuals. Such apparatus is exemplified in the U.S. Pat. Nos. 4,375,886; 4,330,118; 4,890,829; 4,177,985; and 4,934,691.

Accordingly, it may be appreciated there continues to be a need for a new and improved plural position jump rope apparatus as set forth by the instant invention which addresses both the problems of ease of use as well as effectiveness in construction permitting simultaneous use of the organization by a plurality of individuals and in this respect, the present invention substantially fulfills this need.

SUMMARY OF THE INVENTION

In view of the foregoing disadvantages inherent in the known types of jump rope apparatus now present in the prior art, the present invention provides a plural position jump rope apparatus wherein the same utilizes a plurality of jump ropes pivotally secured relative to one another by linkage structure to permit simultaneous use by a plurality of individuals. As such, the general purpose of the present invention, which will be described subsequently in greater detail, is to provide a new and improved plural position jump rope apparatus which has all the advantages of the prior art jump rope apparatus and none of the disadvantages.

To attain this, the present invention provides a first and second jump rope assembly interconnected by first and second jump rope second ends, with the first and second assemblies having first ends permitting ease of rotation of the jump rope assemblies in juxta position relative to one another for use by a plurality of individuals.

My invention resides not in any one of these features per se, but rather in the particular combination of all of them herein disclosed and claimed and it is distinguished from the prior art in this particular combination of all of its structures for the functions specified.

There has thus been outlines, rather broadly, the more important features of the invention in order that the detailed description thereof that follows may be better understood, and in order that the present contribution to the art may be better appreciated. There are, of course, additional features of the invention that will be described hereinafter and which will from the subject matter of the claims appended thereto. Those skilled in the art will appreciate that the conception, upon which this disclosure is based, may readily be utilized as a basis for the designing of other structures methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection of the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved plural position jump rope apparatus which has all the advantages of the prior art jump rope apparatus and none of the disadvantages.

It is another object of the present invention to provide a new and improved plural position jump rope apparatus which may be easily and efficiently manufactured and marketed.

it is a further object of the present invention to provide a new and improved plural position jump rope apparatus which is of a durable and reliable construction.

An even further object of the present invention is to provide a new and improved plural position jump rope apparatus which is susceptible of a low cost of manufacture with regard to both materials and labor, and which accordingly is then susceptible of low prices of sale of the consuming public, thereby making such plural position jump rope apparatus economically available to the buying public.

Still yet another object of the present invention is to provide a new and improved plural position jump rope apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the free end portion of each jump rope assembly employing a securing sleeve.

FIG. 2 is an isometric illustration of the collet structure utilized by the invention.

FIG. 3 is an isometric illustration of the collet sleeve structure utilized by the invention.

FIG. 4 is an orthographic view, taken along the lines 4—4 of FIG. 3 in the direction indicated by the arrows.

FIG. 7 is an isometric exploded view of the second ends interconnected relative to another by utilization of the connecting heads.

DESCRIPTION OF THE PREFERRED EMBODIMENT

Figure 5:
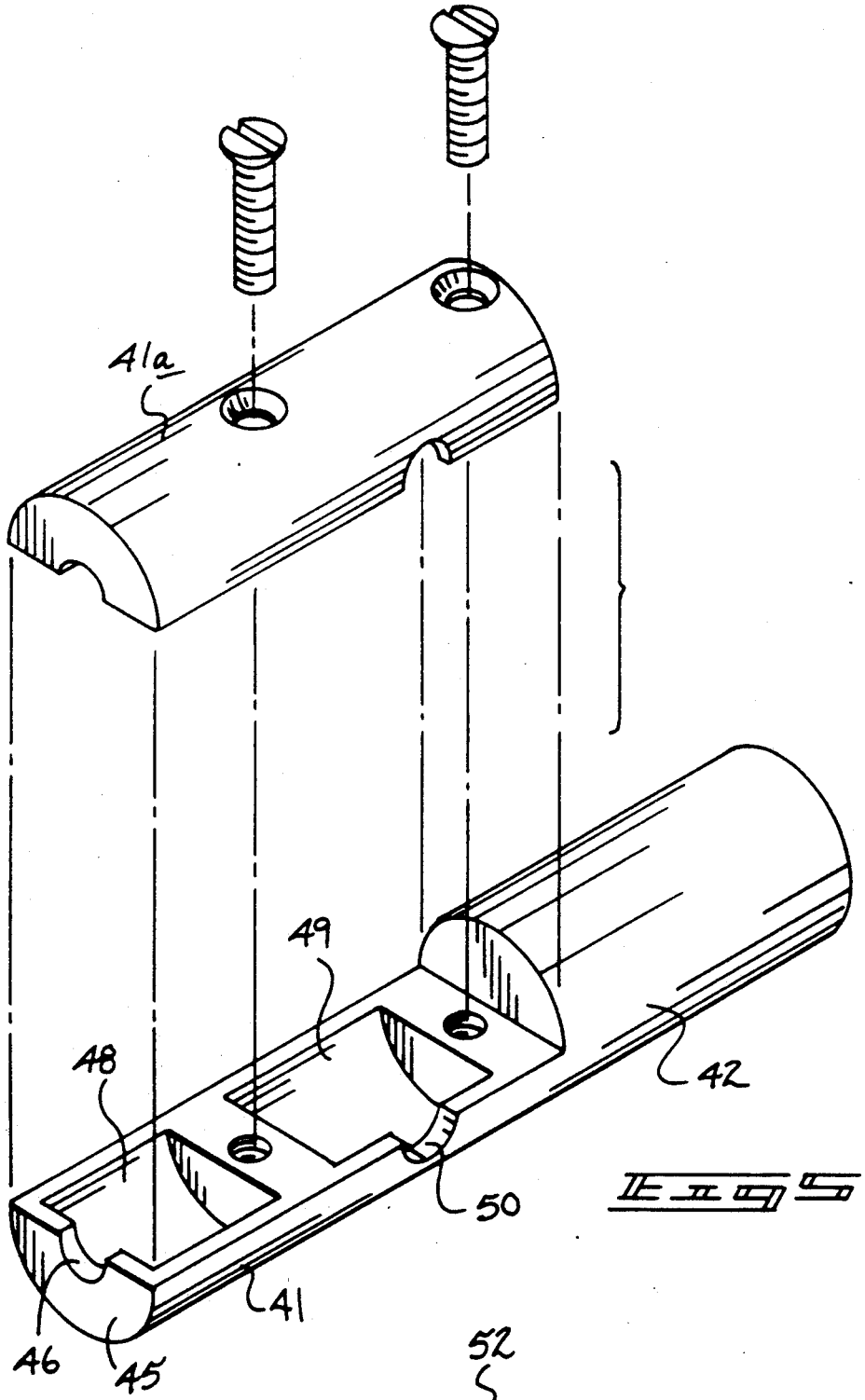
FIG. 5 is an isometric exploded view of connecting head structure utilized by the invention.
Figure 6:
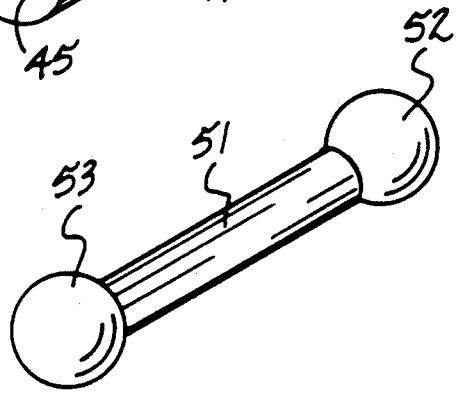
FIG. 6 is an isometric illustration of a connecting rod structure utilized by the invention to interconnect the second ends of each jump rope assembly.
Figure 11:
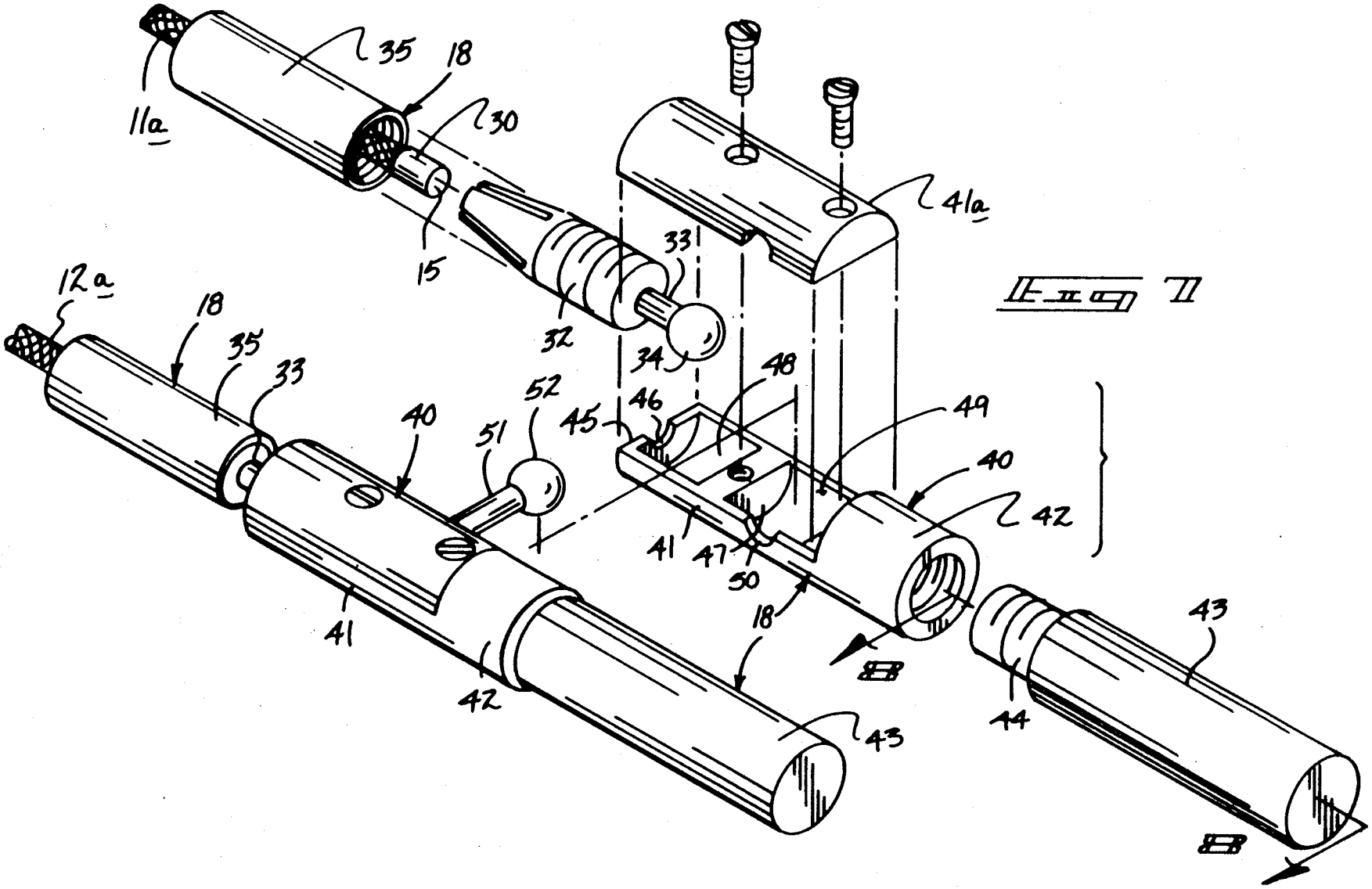
Figure 8B:
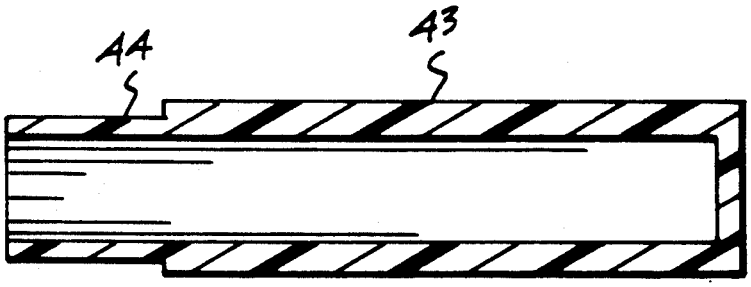
FIG. 8 is an orthographic view, taken along the lines 8—8 of FIG. 7 in the direction indicated by the arrows.
Figure 9:
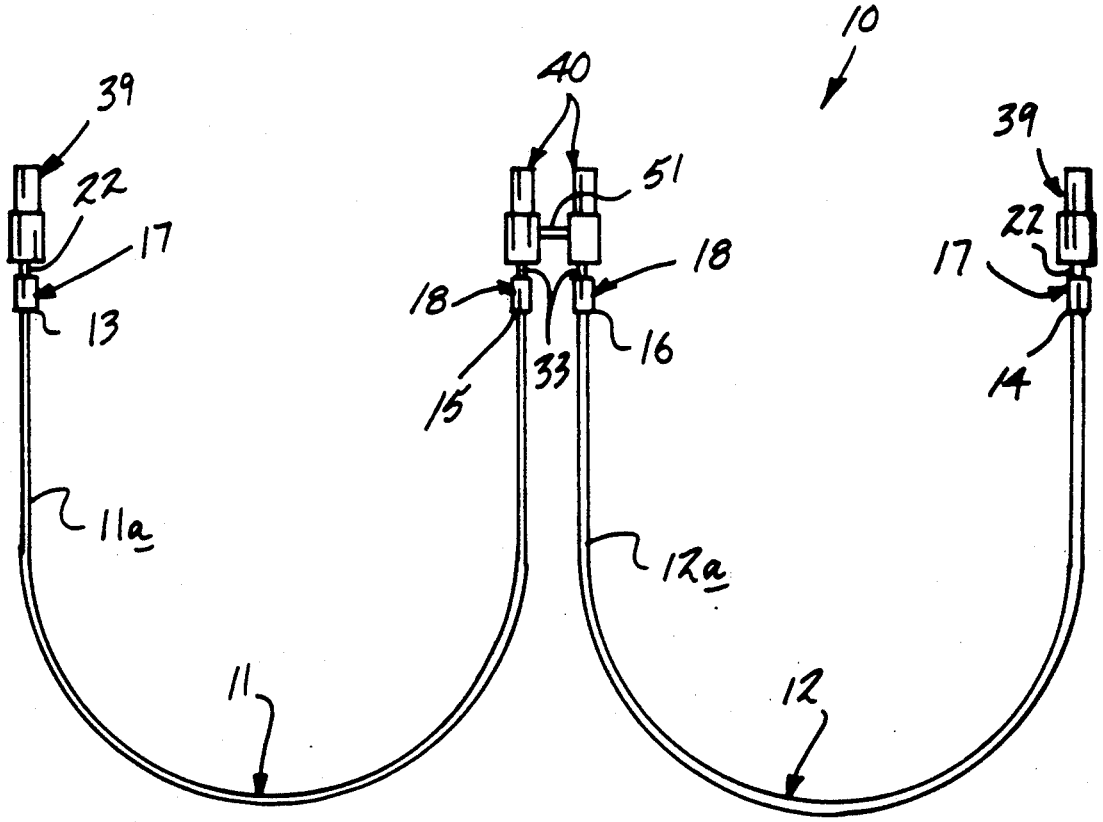
FIG. 9 is an orthographic view of the invention in assembles configuration.

With reference now to the drawings, and in particular to FIGS. 1 to 9 thereof, a new and improved plural position jump rope apparatus embodying the principles and concepts of the present invention and generally designated by the reference numeral 10 will be described.

More specifically, the plural position jump rope apparatus 10 of the instant invention essentially comprises a first jump rope assembly 11 arranged of the secondary relative to a second jump rope assembly 12 employing a first flexible jump rope 11*a* and a second flexible jump rope 12*a* respectively. The first jump rope 11*a* includes respective first and second rope ends 13 and 15 respectively, wherein the second jump rope 12*a* includes second rope first and second ends 14 and 16 respectively. A first end handle assembly 17 is mounted to each of the first ends 13 and 14, with a second end handle assembly 18 mounted to each of the second ends 15 and 16 having a connecting rod 51 therebetween. As the first end handle assemblies 17 are identical as mounted to the first and second jump rope first ends 13 and 14, and similarly the second end handle assembles 18 are identical as mounted to the first and second rope second ends 15 and 16, only one such assembly of the first and second handle assemblies 17 and 18 will be described in detail.

Jump rope first ends include a first end rigid tubular sleeve 19 (see FIG. 1) mounted thereto in a fixed relationship. The first ends and the tubular sleeve assembly are thereafter directed into a first end conical collet 20 having a coaxially aligned first collet externally threaded cylindrical body 21. To the first end cylindrical body 21 is a first collet shank rod 22 coaxially aligned relative to the conical collet and the cylindrical body 20 and 21 respectively, with the shank rod having a first collet spherical head 23 positioned therewithin. The conical collet and associated cylindrical body are directed into a first collet sleeve 24, whereupon the first end 13 and tubular sleeve 19 are positioned within the first collet sleeve directed through a front wall bore 26 of the first collet front wall 25. Therewithin, the first end tubular sleeve 19 is positioned within the collet and the collet is threadedly directed into the first collet sleeve internally threaded cylindrical cavity 28 to direct the first end conical collet 20 into a first collet sleeve conical cavity 27 oriented in adjacency relative to the first collet sleeve front wall 25. Tightening of the collet about the first end tubular sleeve 19 is effected and accordingly, the first collet shank rod 22 and spherical head 23 project exteriorly of the first collect sleeve entrance opening 29 oriented in an opposed end to the front wall 25. The first collect shank rod spherical heads 23 are thereafter received within connecting heads 39. Each connector head 39 is of a construction, as illustrated in the FIGS. 5 and 7; The connecting heads or firs threads 39 are substantially identical to a second connecting heads 40 mounted to each jump rope second end 15 and 16. The first connecting heads 39, as well as the second connecting heads 40 each include a forward semi-cylindrical shell 41 arranged for receiving a forward shell cap 41*a* to define a cylindrical configuration. Each forward shell 41 includes a cylindrical rear shell 42 coaxially aligned with each forward shell and cap, with a cylindrical handle 43 received within the internally threaded rear shell 42, with each handle 43 having an externally threaded handle boss 44 directed into the rear shell 42, in a manner as indicted in the FIG. 7 for example. The forward shell includes a forward shell front wall 45 spaced from and parallel an intermediate web 47. The forward shell front wall includes a forward shell bore 46 to receive the first collet shank rod 22 therethrough, with an associated second connecting head 40 having the forward shell arranged to receive the second conical collet rod 33 therethrough, with the second collet rod 33 having a second collet rod spherical head 34, while the first collet shank rod 22 includes a first collet shank rod spherical head 23 that is captured within a forward cavity 48 of the forward shell defined between the intermediate web 47 an the front wall 45. A rear cavity 49 oriented between the intermediate web 347 and the wear shell 42 includes a rear cavity side wall opening 50 to receive a connecting rod 51. The connecting rod includes respective first and second heads 52 and 53 at opposed ends thereof, wherein the opposed heads are positioned within adjacent rear cavities of adjacent second connecting heads 40. A shell cap 41*a*mounted in a coextensive coverlying relationship relative to the forward shell 41, the second rod spherical heads 34, as ell as the connecting rod spherical heads 52 and 53 are mounted within adjacent second connecting heads 40.

The second collet structure, such as indicated in FIG. 7, is identical to the first collet structure having a second end sleeve 30 in lieu of the first sleeve 19 mounted to the rope second ends 15 and 16. Second conical collets 31 secure the second ends 15 and 16 therewithin, with the second conical collets 31 having second conical collet externally threaded cylindrical bodies 232 extending coaxially and rearwardly thereof, with the second collet rod 33 extending rearwardly and coaxially relative to the second collets 31 and the second collet cylindrical bodies 32. The second collets are received within second collet sleeves 35 of identical construction to the sleeve structure of the first collet sleeves 24. The second collets are arranged for positioning within the second connecting heads 40, while the first collet structure is arranged for reception within the first connecting heads 39.

In this manner as the second ends of the jump ropes 11*a* and 12*a* are secured together, a plurality of individuals cooperate in unison to utilize the first and second jump rope assemblies 11 and 12.

As to the manner of usage and operation of the instant invention, the same should be apparent from the above disclosure, and accordingly no further discussion relative to the manner of usage and operation of the instant invention shall be provided. It should be further noted that the connecting rod structure 51 may in fact be rigid, or alternatively of a flexible and resilient construction to accommodate the simultaneous rotation of the first and second jump rope assemblies as utilized by several individuals.

With respect to the above description then, it is to be realized that the optimum dimensional relationships of the parts of the invention, include variations in size, materials, shape form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plural position jump rope apparatus, comprising, a first jump rope assembly and a second jump rope assembly, with the first jump rope assembly having a first elongate flexible jump rope, including a first rope first end and a first rope second end, with the second jump rope assembly including a second elongate jump rope having a second rope first end and a second rope second end, with the first rope first bend and the second rope first end each including a first collet assembly fixedly mounted thereto, with each first collet assembly having a first handle, and the first rope second end and the second rope second end each including a second collet assembly, and each second collet assembly mounted to each of said first rope second end and said second rope second end, each having a second connecting head wherein only the second connecting head of the first rope second end and the second connecting head of the second rope second end include a connecting rod mounted therebetween, thereby positioning said second ropes in a side by side configuration, thus allowing at least tow persons to use said device simultaneously.

2. An apparatus as set forth in claim 1 wherein the connecting rod is of a resilient construction.

3. An apparatus as set forth in claim 2 wherein the first rope first end and the second rope first end each include a first rigid tubular sleeve, and each first collet assembly includes a first conical collet, and each first conical collet includes a first collet externally threaded cylindrical body coaxially aligned with a respective first conical collet, and a first collet shank rod fixedly and coaxially aligned with a respective first collet cylindrical body, and wherein the first collet cylindrical body is externally threaded, and the first collet shank rod includes a first rod spherical head, and each first collet assembly include a first collet sleeve, with each first collet sleeve including a first collet sleeve front wall, and each first collet sleeve front wall includes a first collet sleeve front wall bore, and each first collet front sleeve bore receives the first tubular sleeve therethrough, and each first tubular sleeve is received within a respective first end conical collet, and each first collet sleeve includes a conical cavity receiving the first rend conical collet and a second internally threaded cylindrical cavity coaxially aligned with and adjacent the first collet conical cavity, wherein the first collet sleeve cylindrical cavity threadedly received the first collet cylindrical body,. and the first collet shank rod of each first collet assembly projects beyond the first collet sleeve received within the first connecting head.

4. An apparatus as set forth in claim 3 wherein each second collet assembly includes a second connecting head, wherein the first connecting head receives a first collet shank rod, and each second connecting head includes a second collet shank rod, wherein the first connecting head and the second connecting head each include a semi-cylindrical forward shell, and each semi-cylindrical forward shell includes a shell cap coextensive therewithin, and each forward shell includes an internally threaded tubular rear shell, and each tubular rear shell includes a threaded handle therewithin, and each forward shell includes a first cavity spaced from in adjacency to a second cavity, and the first cavity of the first connecting head includes the first rod spherical head and the second connecting head forward cavity receives the second connecting rod spherical head therewithin, and the second connecting head rear cavity receives an opposed distal end of the connecting rod, with each rear cavity of the second connecting head having a side wall opening directed through the forward shell to permit sliding reception of the connecting rod therethourgh.

* * * * *